United States Patent [19]

Ohie

[11] 4,438,496

[45] Mar. 20, 1984

[54] ELECTRONIC FUEL INJECTION FEEDBACK CONTROL METHOD FOR INTERNAL COMBUSTION ENGINES

[75] Inventor: Tomonori Ohie, Higashi-Matsuyama, Japan

[73] Assignee: Diesel Kiki Co., Ltd., Saitama, Japan

[21] Appl. No.: 269,878

[22] Filed: Jun. 3, 1981

[30] Foreign Application Priority Data

Jun. 11, 1980 [JP] Japan ..... 55-78691

[51] Int. Cl.[3] ..... F02M 51/06; F02D 5/02

[52] U.S. Cl. ..... 364/431.05; 123/458; 123/472; 123/478; 123/480; 364/431.07

[58] Field of Search ..... 364/431.04, 431.05, 364/431.06; 123/357, 472, 458, 478, 480, 486, 494

[56] References Cited

U.S. PATENT DOCUMENTS

| | | | |
|---|---|---|---|
| 3,682,152 | 8/1972 | Müller-Berner | 123/478 X |
| 4,108,115 | 8/1978 | Williams et al. | 123/486 |
| 4,174,694 | 11/1979 | Wessel et al. | 123/357 |
| 4,217,862 | 8/1980 | Fort et al. | 123/472 |
| 4,258,674 | 3/1981 | Wolff | 123/478 |
| 4,280,464 | 7/1981 | Kanai et al. | 123/478 X |
| 4,343,274 | 8/1982 | Butscher | 123/357 |
| 4,351,299 | 9/1982 | Costello | 123/472 |
| 4,359,032 | 11/1982 | Ohie | 123/458 |

FOREIGN PATENT DOCUMENTS 3016171 8/1981 Fed. Rep. of Germany .

OTHER PUBLICATIONS

Eisele: Electronic Control of Diesel Passenger Cars, SAE Technical Paper Series #800167, Feb. 1980.

*Primary Examiner*—Felix D. Gruber
*Attorney, Agent, or Firm*—Frishauf, Holtz, Goodman & Woodward

[57] ABSTRACT

A feedback control method for electronically controlling the fuel injection for an internal combustion engine, which is characterized by detecting the actual nozzle needle lift and actual injection pressure of a fuel injection valve to arithmetically calculate an actual fuel injection quantity from the detected values of nozzle needle lift and injection pressure by means of electronic computer means, detecting the values of factors indicative of the operating condition of the engine such as engine speed and engine load to arithmetically calculate a required fuel injection quantity from the detected values of the above factors by means of the electronic computer means, and correcting the calculated required injection quantity with reference to the calculated actual injection quantity.

15 Claims, 12 Drawing Figures

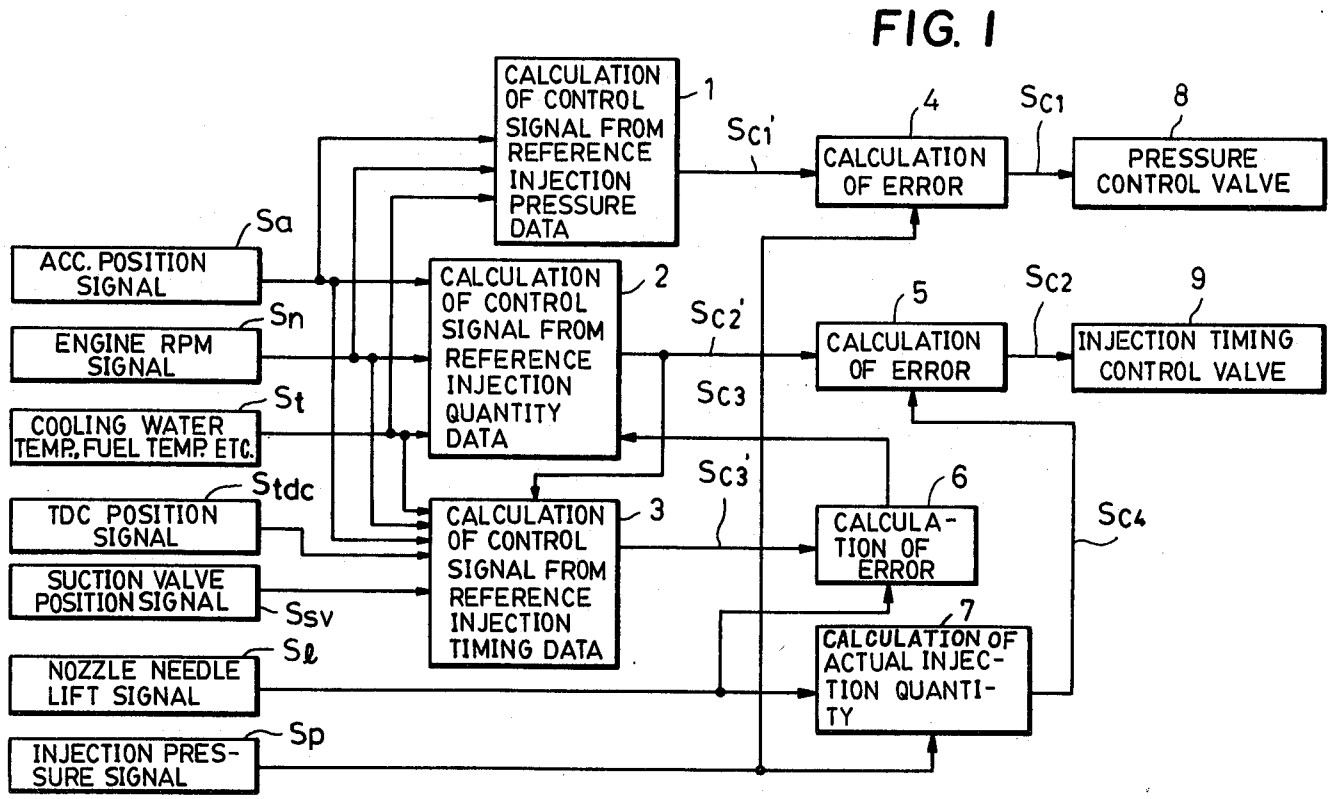
FIG. 1
CALCULATION OF CONTROL SIGNAL FROM REFERENCE INJECTION PRESSURE DATA
1
Sc1'
CALCULATION OF ERROR
4
Sc1
PRESSURE CONTROL VALVE
8
Sc2'
Sc3
CALCULATION OF CONTROL SIGNAL FROM REFERENCE INJECTION QUANTITY DATA
2
CALCULATION OF ERROR
5
Sc2
INJECTION TIMING CONTROL VALVE
9
Sc3'
CALCULATION OF CONTROL SIGNAL FROM REFERENCE INJECTION TIMING DATA
3
CALCULATION OF ERROR
6
Sc4
CALCULATION OF ACTUAL INJECTION QUANTITY
7
Sa
ACC. POSITION SIGNAL
Sn
ENGINE RPM SIGNAL
St
COOLING WATER TEMP. FUEL TEMP. ETC.
Stdc
TDC POSITION SIGNAL
Ssv
SUCTION VALVE POSITION SIGNAL
Sℓ
NOZZLE NEEDLE LIFT SIGNAL
Sp
INJECTION PRESSURE SIGNAL

ELECTRONIC FUEL INJECTION FEEDBACK CONTROL METHOD FOR INTERNAL COMBUSTION ENGINES

BACKGROUND OF THE INVENTION

The present invention relates to an electronic feedback control method applicable to internal combustion engines provided with fuel injection valves and more particularly to an electronic feedback control method for controlling the quantity of fuel being injected into an internal combustion engine through a fuel injection valve, in which the flow rate of fuel injected through the fuel injection valve is detected for control of the fuel injection quantity.

A Diesel engine is conventionally provided with fuel injection valves formed of injection nozzles which are arranged to project into respective engine cylinders. Fuel is supplied to the fuel injection valves from a fuel injection pump or injection pumps through respective injection pipes and hence is injected into the respective engine cylinders through the valves. In a unit injector, fuel injection is carried out through a fuel injection valve by means of the pumping action of a fuel injection pump provided integrally with the fuel injection valve and formed of solenoid means or the like. The fuel injection quantity Q ($mm^3/st$) which is obtained by these fuel injection valves can be expressed by the following equation:

$$Q=CAt\sqrt{P}$$

where:

C=constant,

A=effective discharge area of the injection nozzle of a fuel injection valve, t=injection period, P=injection pressure ($kg/cm^2$).

As is understood from the above equation, the fuel injection quantity can be controlled by varying any of the members A, t, P.

However, no control system has been proposed as yet which is adapted to control the fuel injection quantity by detecting the quantity of fuel injected through an injection nozzle and directly feeding the detected value back to the control section of the system.

In conventional fuel injection systems, the injection quantity is controlled in such an indirect manner that the position of the control rack engaging with pumping plungers in an in-line type fuel injection pump or the position of the control sleeve (or the regulating collar) engaging with a pumping plunger, in a distributor-type fuel injection pump is detected and the detected position is taken as a position corresponding to the actual injection quantity. However, according to such conventional arrangements, the actual injection quantity during each injection cannot be fed back to the control section with accuracy, making it impossible to control the injection quantity with accuracy. While in conventional unit injectors, it is difficult to detect the injection quantity since neither a control rack nor a control sleeve is provided in a conventional unit injector. Therefore, feedback control of the fuel injection quantity is little available with conventional unit injectors.

OBJECT AND SUMMARY OF THE INVENTION

It is the object of the invention to provide an electronic feedback control method for controlling the fuel injection for an internal combustion engine, in which the actual nozzle needle lift and actual injection pressure of an injection nozzle are detected to arithmetically calculate an actual fuel injection quantity from the detected values by means of electronic computer means, the calculated actual fuel injection quantity being used for correction of a required fuel injection quantity corresponding to the operating condition of the engine.

According to the invention, there is provided a method for controlling the injection of fuel being injected into at least one cylinder of an internal combustion engine through a fuel injection valve having a nozzle holder and a nozzle needle arranged within the nozzle holder. According to the present method, the lift amount of the nozzle needle is detected by means of a nozzle needle lift sensor arranged within the nozzle holder. Also detected is fuel pressure present in an injecting fuel passage in the nozzle holder by means of a pressure sensor. An actual value of fuel injection quantity is arithmetically calculated from the detected values of nozzle needle lift and fuel pressure by means of electronic computer means. On the other hand, the values of factors indicative of the operating condition of the engine are detected. A required value of fuel injection quantity is arithmetically calculated from the detected values of the factors by means of electronic computer means, followed by arithmetically calculating the difference between the calculated required value of fuel injection quantity and the calculated actual value of fuel injection quantity. The quantity of fuel to be injected into the cylinder of the engine during the next fuel injection is controlled with reference to the above calculated difference.

The term "nozzle needle lift" used throughout the specification means the amount of lift of the nozzle needle, i.e. the stroke through which the nozzle needle is lifted or has been lifted.

The above and other objects, features and advantages of the invention will be more apparent from the ensuing detailed description taken in connection with the accompanying drawings.

BRIEF DESCRIPTION OF THE DRAWINGS

FIG. 1 is a synoptic diagram illustrating an arrangement according to an embodiment of the method of the invention;

DETAILED DESCRIPTION

Figure 2:
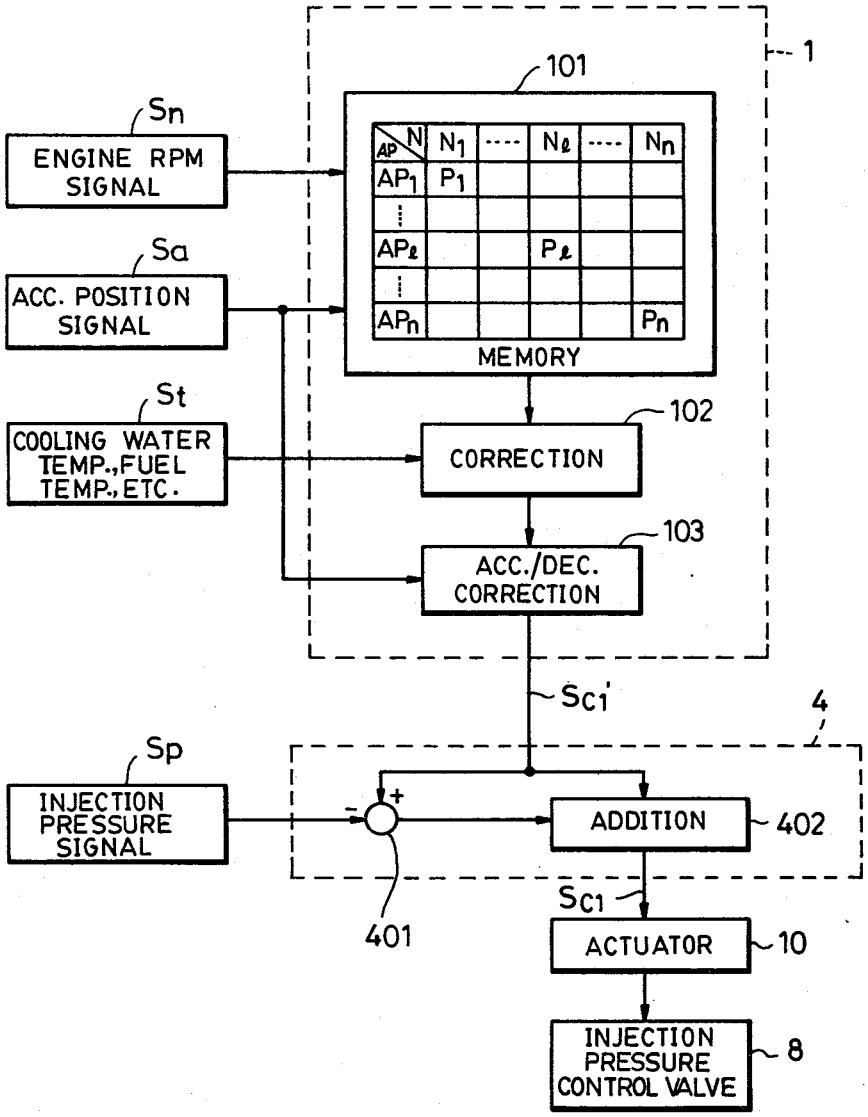
FIG. 2 is a diagram illustrating the injection pressure control block of the arrangement of FIG. 1.

FIG. 1 synoptically illustrates an arrangement according to an embodiment of the method of the present invention. Blocks 1, 2 and 3 are supplied with an actual accelerator position signal Sa, an actual engine rpm signal Sn and a signal St indicative of actual engine temperature which can be represented by cooling water temperature, fuel temperature, etc. In the block 1, a control signal Sc1' having a required injection pressure control value, which corresponds to the above signals Sa, Sn, St, is calculated from predetermined reference injection pressure data and is supplied to a block 4. In the block 4, the difference between the value of the control signal Sc1' and that of the actual injection pressure signal Sp is calculated, and the resulting error component is added to the original signal Sc1'. The resulting control signal Sc1 is applied to an injection pressure control valve 8 to control same. On the other hand, in the block 2, a control signal Sc2' having a required injection quantity control value, which corresponds to the signals Sa, Sn, St, is calculated from predetermined reference injection quantity data. Referring to the block 3, this block 3 is also supplied with a signal Stdc representing the actual top-dead-center position of an engine piston and a signal Ssv representing the actual position of an engine suction valve, in addition to the above-mentioned actual value signals Sa, Sn, St. The block 3 is further supplied with the above required injection quantity control signal Sc2' as an engine load signal. In the block 3, a control signal Sc3' having a required injection timing control value, which corresponds to the above-mentioned input signals, is calculated from predetermined reference injection timing data and is fed to a block 6. In the block 6, this control signal Sc3' has its value corrected with reference to the value of an actual nozzle needle lift signal S1 and that of the resulting corrected control signal Sc3 is supplied to the block 2. The block 2 produces a required injection quantity control signal Sc2' upon being supplied with the corrected control signal Sc3 and applies it to the block 5. The block 5 is also supplied with a signal Sc4 representing an actual injection quantity from a block 7, and calculates the difference between the value of the control signal Sc2' and that of the actual value signal Sc4 and adds the resulting error component to the original signal Sc2' to supply the resulting control signal Sc2 to an injection timing control valve 9 to control same. In the block 7, the above actual injection quantity signal Sc4 is calculated from the nozzle needle lift signal S1 and the injection pressure signal Sp.

FIG. 2 illustrates more in detail the injection pressure control section of the arrangement of FIG. 1. The engine rpm signal Sn and the accelerator position signal Sa are supplied to the block 1 of FIG. 1. The block 1 has a memory 101 in which are stored predetermined reference injection pressure data P (P1 . . . P1 . . . Pn) relating to engine rpm's N (N1 . . . N1 . . . Nn) and accelerator positions (engine load) Ap (AP1 . . . AP1 . . . APn). A required target injection pressure value P which corresponds to the input signals Sn, Sa is read from the data in the memory 101. The target injection pressure signal P thus read out has its value corrected with reference to the value of the temperature signal St at correcting means 102 and further corrected with reference to the value of the accelerator position signal Sa at acceleration/deceleration correcting means 103. That is, the correcting means 103 is adapted to determine the rate of change of the accelerator position indicated by the signal Sa relative to the progress of time, to thereby determine whether the engine is in an accelerating condition, in a decelerating condition or in another operating condition. This corrected control signal Sc1' is, on one hand, subjected to calculation of error at point 401 of the block 4 of FIG. 1 and the resulting difference is added to the value of the original signal Sc1' at an adder 402 to obtain the control signal Sc1 for control of the injection pressure control valve 6 through an actuator 10.

Figure 3:
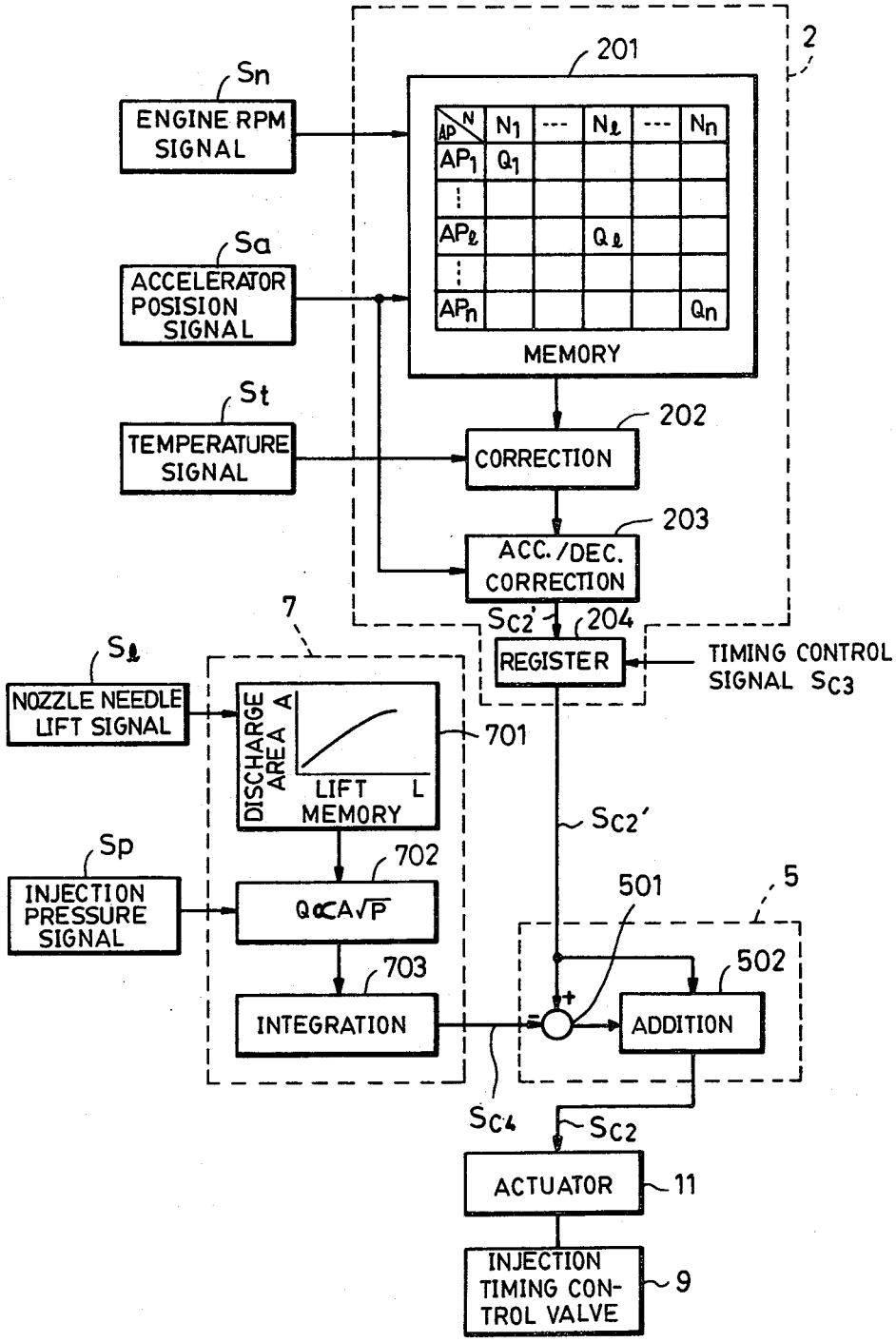
FIG. 3 is a diagram illustrating the injection period control block of the same arrangement.
Figure 6:
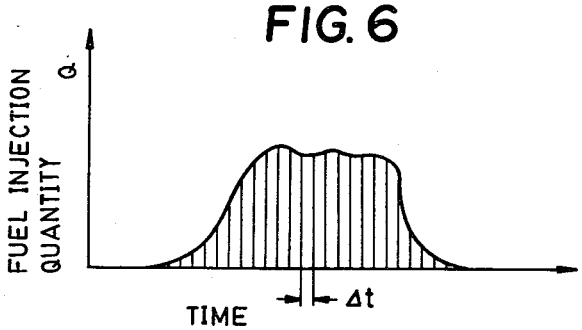
FIG. 6 is an explanatory diagram illustrating the manner of calculation of the actual injection quantity according to the program of FIG. 5.

FIG. 3 illustrates more in detail the injection quantity control section of the arrangement of FIG. 1. The block 2 is supplied with the engine rpm signal Sn and the accelerator position signal Sa. The block 2 has a memory 201 in which are stored predetermined reference injection quantity data Q (Q1 . . . Q1 . . . Qn) relating to engine rpm's N (N1 . . . N1 . . . Nn) and accelerator positions (engine load) AP (AP1 . . . AP1 . . . APn). A required target injection quantity value Q is read from the data in the memory 201, which corresponds to the values of the input signals Sn, St. The target injection quantity signal Q thus read out has its value corrected with reference to the value of the temperature signal at correcting means 202 and then corrected with reference to the value of the accelerator position signal Sa at acceleration/deceleration correcting means 203. The resulting corrected control signal Sc2' is stored into a register 204 upon the register being supplied with the injection timing control signal Sc3 from the block 6 in FIG. 6 and simultaneously applied to the block 5. On the other hand, in the block 7 predetermined discharge area data relating to nozzle needle lifts L are stored in the memory 701 of the block 7. An injection nozzle discharge area A is read from the data, which corresponds to the value of an actual nozzle needle lift signal S1, and calculation $Q \propto A\sqrt{P}$ is carried out using the discharge area A thus read out and the value of the actual injection pressure signal Sp, followed by an integration operation at point 703 as hereinlater referred to, to determine an actual injection quantity control signal Sc4. As previously mentioned, this signal Sc4 is applied to the block 5, where the difference between the values of the signals Sc2', Sc4 is obtained at point 501 and this error component is added to the original signal Sc2' at an adder 502. The resulting control signal Sc2 is fed to an actuator 11 which operates on the signal Sc2 to control the valve opening timing and valve opening period of the injection timing control valve 9.

Figure 4:
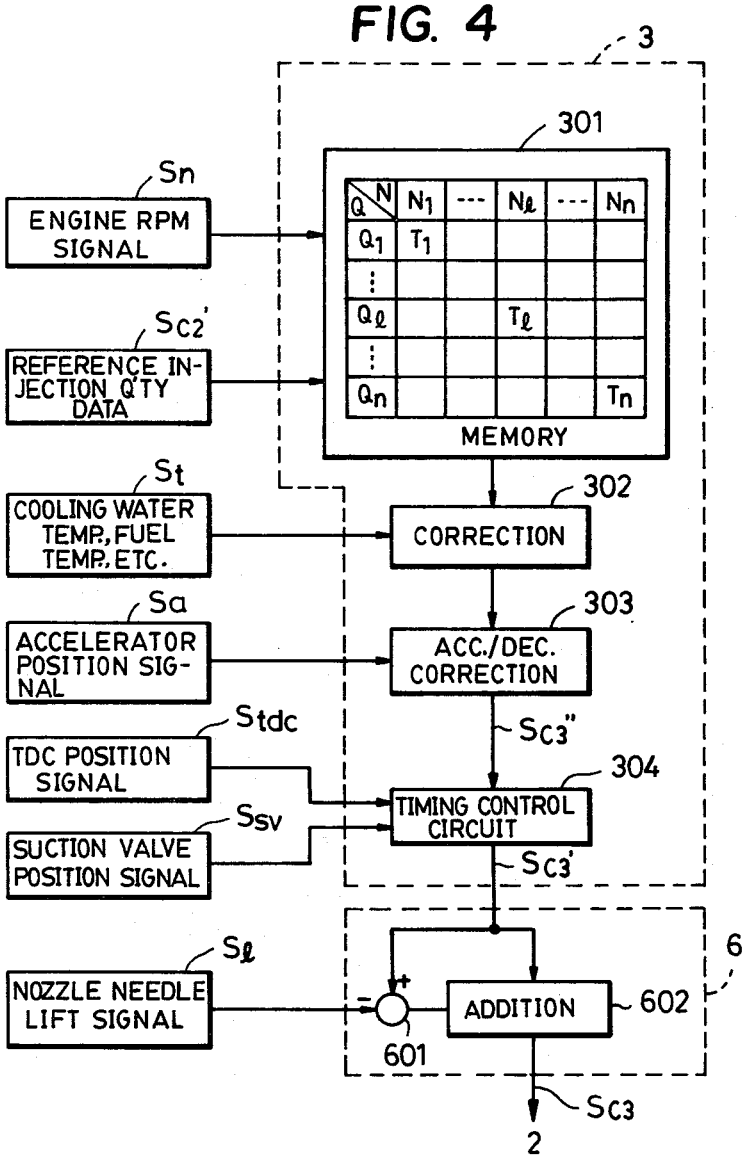
FIG. 4 is a diagram illustrating the injection timing control block of the same arrangement.

FIG. 4 illustrates more in detail the injection timing control section of the arrangement of FIG. 1. The block 3 in FIG. 1 is supplied with the engine rpm control signal Sn and the control signal Sc2' produced from the block 2 in FIG. 1. The latter signal Sc2' is used as an engine load signal here. Stored in the memory 301 of the block 3 in FIG. 1 are predetermined reference injection beginning data T (T1 . . . T1 . . . Tn) relating to engine rpm's N (N1 . . . N1 . . . Nn) and fuel injection quantities Q (Q1 . . . Q1 . . . Qn). A required target injection beginning value T corresponding to the input signals Sn, Sc2' is read from the data in the memory 301. The target injection beginning value T thus read out has its value corrected with reference to the value of the temperature signal St at correcting means 302 and further corrected with reference to the value of the accelerator position signal Sa at acceleration/deceleration correcting means 303. The resulting control signal Sc3" is applied to a timing control circuit 304 which in turn operates on this signal Sc3" as well as the top-dead-center position signal Stdc and the suction valve position signal Ssv to produce a control signal Sc3' with timing relating to the input signals Stdc, Ssv. The control signal Sc3' is supplied to the block 6, where the difference between the value of nozzle needle lift signal S1 and that of the signal Sc3' is obtained at point 601 and the resulting error component is added to the original signal Sc3' at an adder 602. The resulting control signal Sc3 is supplied to the injection period calculating block 2 in FIG. 2.

Figure 5:
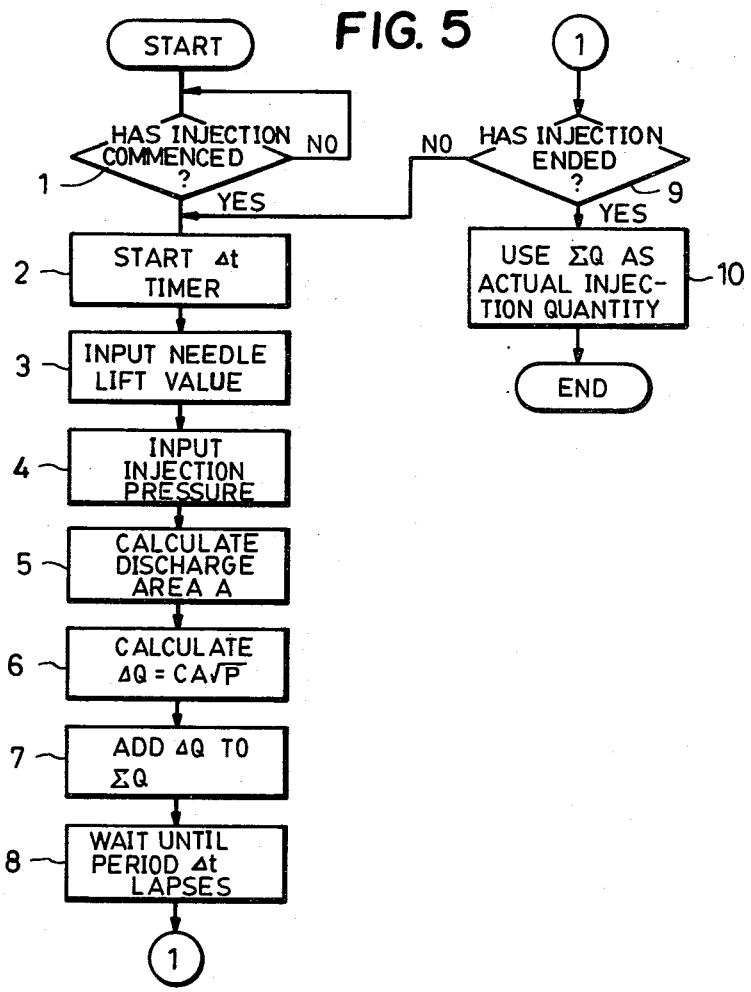
FIG. 5 is a flow chart illustrating a program for arithmetically calculating the actual injection quantity.

FIG. 5 is a flow chart of a program for carrying out the flow rate detection in the block 7 in FIG. 1. According to the invention, the actual injection quantity is determined from the nozzle needle lift 1 of the injection nozzle and the injection pressure P. In the illustrated embodiment, the injection quantity achieved during each injection is determined by integrating an injection quantity ΔQ per unit time Δt, in accordance with the following equation:

$$\Delta Q = CA\sqrt{P} \times \Delta t$$

In FIG. 5, at the point 1, a determination is made as to whether or not injection has commenced. If the answer to this question is "no", the same determination is repeated until the answer "yes" is obtained. If the answer is "yes" at the point 1, at Δt timer is started at the point 2, while simultaneously the actual nozzle needle position signal S1 and the actual injection pressure P are inputted to electronic computer means at the points 3, 4. The actual effective discharge area value A of the injection nozzle is calculated from the former signal S1 at the point 5, while the unit injection quantity ΔQ is calculated from the calculated value A and the actual injection pressure value P at the step 6. The calculated value ΔQ is added to the sum ×Q of values ΔQ calculated in the preceding unit times Δt during the present injection at the point 7. Then, the lapse of the present unit time Δt is waited at the point 8. When the present unit time Δt time has lapsed, a determination is made as to whether or not the present injection has terminated, at the point 9. If the answer to this question is "yes", the value ΣQ obtained at the point 7 is used as the actual injection quantity at the point 10. On the other hand, if the answer to the question at the point 9 is "no", the above operations at the points 2–9 are repeated until the answer "yes" is obtained.

Figure 7:
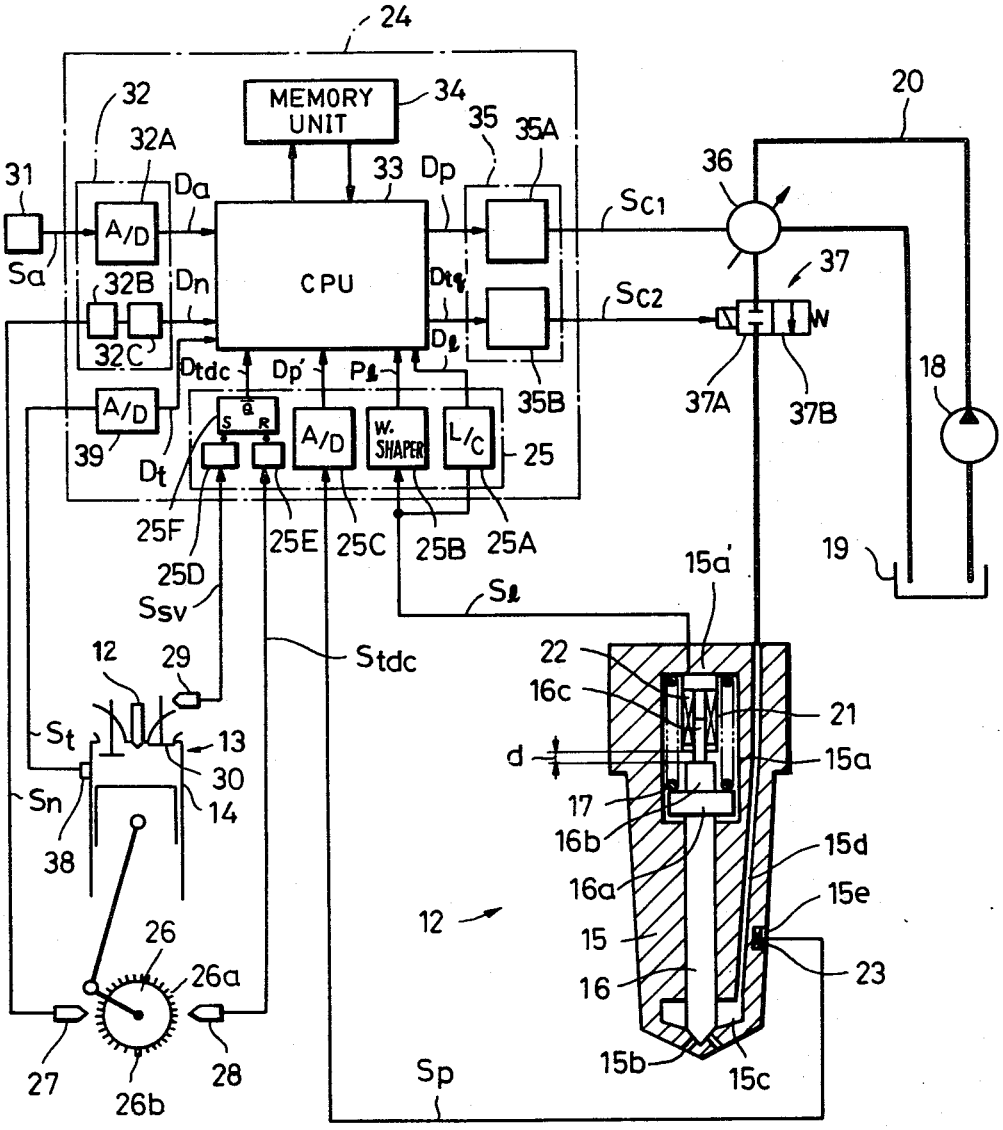
FIG. 7 is a schematic illustration of an embodiment of a fuel injection control system for putting into practice the method according to the invention.
Figure 8:
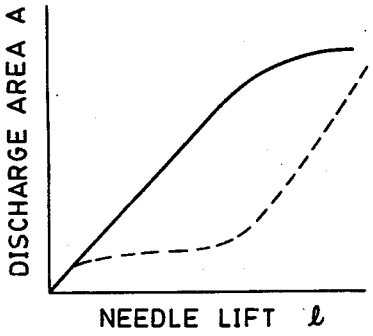
FIG. 8 is a graph showing the relationship between nozzle needle lift and effective discharge area of an injection nozzle.

FIG. 7 illustrates a complete control system using the above-mentioned injection quantity detecting method according to the invention. A fuel injection valve 12 is mounted in the head of a cylinder 14 of an engine 13. A nozzle needle 16 is slidably disposed within the nozzle holder 15 of the fuel injection valve 12. The nozzle holder 15 has a chamber **15*a* in which a rear end portion of the nozzle needle 16 remote from the injection hole portion is accomodated. Also mounted in this chamber 15*a* is a coil spring 17 with its one end seated against a flange 16*a* formed on the nozzle needle 16 for setting of the valve opening pressure of the nozzle needle 16. Communicated via a pressure chamber 15*c* with the injection hole portion 15*b* at which the tip of the nozzle needle 16 is located is a fuel passage 15*d* formed within the nozzle holder 16. Fuel delivered under pressure from a fuel tank 19 by means of a fuel pump 18 is made to travel through a fuel supply line 20, an injection pressure control valve 36 and an injection timing control valve 37 to be supplied to the fuel injection valve 12 and then injected into the cylinder 14 of the engine 13 through the injection hole portion 15*b*. The nozzle needle 16 has a rear end portion 16*b* rearwardly projected by a predetermined distance from the flange 16*a*. Disposed centrally at a rear end 15*a'* of the chamber 15*a* is a nozzle needle lift sensor 21 with its front end spaced from the rear end portion 16*b* of the needle 16 at a predetermined distance d prescribing a maximum lift of the needle 16. This nozzle needle lift sensor 21 is formed of a coil 22 and a rod 16*c* formed integrally with the nozzle needle 16 and located in part in the coil 22, for instance. The rod 16*c*, which is formed of a magnetic material, is projected from the rear end portion 16*b* in a direction away from the nozzle hole portion 15*b*. A separately fabricated rod member may be mounted in a projected manner on the rear end portion 16*b* of the nozzle needle 16 in place of the rod 16*c*. The coil 22 has its inductance variable as a function of displacement of the rod 16*c* during lifting of the nozzle needle 16 to produce an inductance signal S1. That is, the inductance of the coil 22 is a function of the amount of lifting of the nozzle needle 16 and accordingly the signal S1 has a value corresponding to the amount of lifting 1 of the nozzle needle 16. It goes without saying that the signal S1 also corresponds to the lift timing of the nozzle needle 16. The effective discharge area A of the injection nozzle 12 is variable as a function of the lifting amount 1 of the nozzle needle 16. More specifically, in the case of a hole nozzle shown in FIG. 7, the effective discharge area A is variable with respect to the lifting amount 1 as indicated by the solid line in FIG. 8, while in the case of a pintle nozzle, the effective discharge area A is variable with respect to the lifting amount 1 as indicated by the break line in FIG. 8**.

The nozzle holder 15 has its outer peripheral wall formed therein with a recess **15*e* at a location close to the fuel passage 15*d* and extending therealong, within which is disposed a strain gauge 23 in a manner secured to the bottom. The fuel pressure supplied from the fuel pump 18 into the fuel passage 15*d* is very high and there occurs a change in the pressure within the fuel passage 15*d* when fuel is injected through the injection hole portion 15*b*. During fuel injection, there occur strains in the portion of the nozzle holder 15 on the perimeter of the fuel passage 15*d*, which correspond to the change in the fuel pressure within the passage 15*d*. The strain gauge 23** detects the strains to produce a signal Sp. Therefore, the signal Sp corresponds to the actual fuel injection pressure P.

The nozzle needle lift signal S1 and the injection pressure signal Sp are supplied to an injection timing input unit 25 of an electronic control device 24 which may preferably be formed of a microcomputer.

The engine rpm sensor 27 and the piston top-dead-center position sensor 28 are provided around the output shaft (e.g., crank shaft) 26 of the engine 13 at locations close to a number of teeth **26*a* circumferentially arranged on the outer periphery of the output shaft 26 at equal intervals. The engine rpm sensor 27, which may be formed of an electromagnetic pickup, is arranged to detect the number of teeth passing by the sensor 27** during rotation of the output shaft 26 to produce a signal Sn corresponding to the detected number of teeth. The top-dead-center position sensor 28 is sensitive to passing of a protuberance 26b formed on the output shaft at a predetermined location by the sensor to produce a signal Stdc. The suction valve position sensor 29, which may be formed of an electromagnetic pickup, is arranged close to the valve rod, formed of a magnetic material, of a suction valve 30 and produces a signal Ssv upon detecting closing of the suction valve 30. The accelerator position sensor 31, which may be formed of a potentiometer, is coupled to an accelerator pedal, not shown, and produces an accelerator position signal Sa upon detecting stepping-on of the accelerator pedal. The piston top-dead-center position signal Stdc and the suction valve position signal Ssv are supplied to the injection timing input unit 25 of the electronic control device or microcomputer 24, while the engine rpm signal Sn and the accelerator position signal Sa are supplied to the engine rpm input unit 32.

Further, a sensor 38 is embedded in the peripheral wall of the engine cylinder 14 to detect the engine cooling water temperature and supply a detected value signal St to a temperature input unit 39 in the electronic control device 24.

In the injection timing input unit 25, an L/C oscillator 25A and a waveform shaper 25B are arranged to be supplied, respectively, with a nozzle needle lift signal S1 from the nozzle needle lift sensor 21 and supply a pulse signal D1 and a pulse signal P1, both corresponding in frequency to the signal S1, to a central processing unit (hereinafter called "CPU") 33 in the electronic control device 24. An analog-to-digital (A/D) converter 25C is arranged to be supplied with an injection pressure signal Sp from the pressure sensor 23 to supply a digital signal Dp' corresponding in value to the signal Sp to CPU 33. Waveform shapers 25D, 25E are arranged to be supplied, respectively, with detected value signals Ssv, Stdc from the suction valve position sensor 29 and the top-dead-center position sensor 28 to apply their output signals to the S-input terminal and R-input terminal of an RS flip flop 25F, respectively. The flip flop 25F is set by the output of the waveform shaper 25D which corresponds to closing of the suction valve 30, to produce a binary output of O through its $\overline{Q}$-output terminal, while it is set by the output of the waveform shaper 25E which corresponds to the compression top-dead-center position of the piston immediately after closing of the suction valve, to produce a binary output of 1.

In the engine rpm input unit 32, an analog-to-digital (A/D) converter 32A is arranged to be supplied with a detected value signal Sa from the accelerator position sensor 31 and convert the signal Sa into a digital signal Da corresponding in value to the signal Sa. A waveform shaper 32B is arranged to be supplied with an engine rpm signal Sn from the engine rpm sensor 27 and subject the signal Sn to waveform shaping and then apply the resulting signal to a counter 32C. The counter 32C is adapted to count the pulses of the signal from the waveform shaper 32B for a predetermined period of time to produce a corresponding counted value Dn.

Further, the temperature input unit 39, which may be formed of an analog-to-digital (A/D) converter, is adapted to convert a detected value signal St from the temperature sensor 38 into a digital signal Dt corresponding in value to the signal St and supply it to CPU 33.

A memory unit 34 is connected to CPU 33, in which are stored predetermined reference fuel injection pressure data and predetermined reference injection quantity data, both relating to engine rpm's and accelerator positions, as well as predetermined reference injection timing data relating to nozzle needle lifts and engine piston positions.

CPU 33 operates on a predetermined program to read a required target injection pressure value from the injection pressure data in the memory unit 34, which corresponds to the input signals Da, Dn. Then, the required target injection pressure value is subjected to corrections with reference to the actual injection pressure signal Dp', accelerator position (acceleration/deceleration) signal Da and cooling water temperature signal Dt, and the resulting injection pressure control signal Dp is produced at the output of CPU 33. CPU 33 further operates on a predetermined program to read a required target injection quantity value from the injection quantity data in the memory unit 34, which corresponds to the input signals Dn, Da. Then, the required target injection quantity value is corrected with reference to the actual signals Dt, Da. Further, a required target injection timing value is read from the injection timing data in the memory unit 34, which corresponds to the above corrected target injection quantity value and the input signal Dn, followed by corrections of the target injection timing value thus read out with reference to the input signals Dt, Da, Dtdc, D1. An actual injection quantity value is calculated from the input signals D1, Dp, followed by further correction of the above corrected target injection quantity value with reference to the calculated actual injection quantity value. Then, a control signal Dtq indicative of the finally corrected injection quantity value and the above corrected target injection timing value is outputted from CPU. The output data Dp, Dtq from CPU 33 are applied, respectively, to the injection pressure output circuit 35A and injection quantity (injection period)/injection timing output circuit 35B of the output unit 35.

Figure 9:
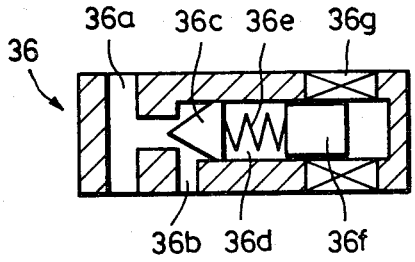
FIG. 9 is a sectional view illustrating an embodiment of a pressure control valve applicable to the system of FIG. 7.
Figure 10:
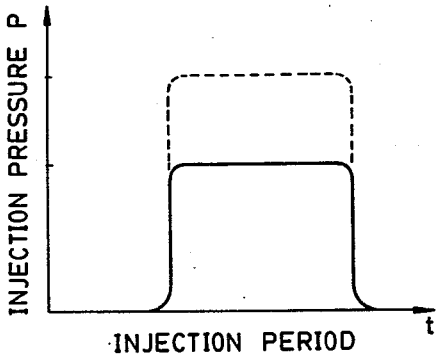
FIG. 10 is a graph showing the operating characteristic of the pressure control valve.

The injection pressure output circuit 35A acts to response to the signal Dp to supply a corresponding injection pressure control signal Sc1 to the pressure control valve 36 to cause it to regulate the injection pressure to a required value. This pressure control valve 36 has a construction such as illustrated in FIG. 9. A valve body 36c is arranged within a valve bore 36d for displacement to close a return passage 36b branching from a fuel supply passage 36a and communicating with the fuel tank 19 in FIG. 7. Further arranged within the valve bore 36d are a coil spring 36e and a movable member 36f formed of a magnetic material. Upon energization of a solenoid 36g arranged around the valve bore 36d, the movable member 36f is displaced to vary the urging force of the coil spring 36e against the valve body 36c to thereby regulate the flow rate of fuel being introduced into the return passage 36b to obtain a controlled fuel pressure in the fuel passage 36a as shown in FIG. 10.

Figure 11:
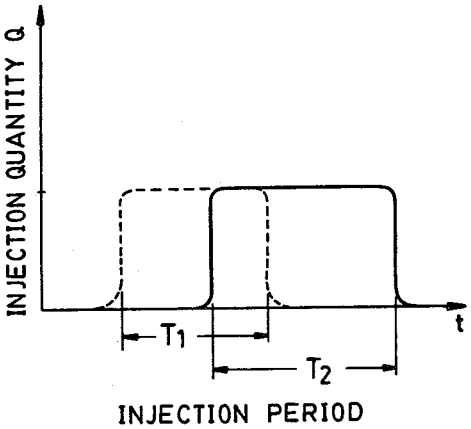
FIG. 11 is a graph showing the operating characteristic of an injection timing control valve applicable to the system of FIG. 7.

The injection quantity/injection timing output circuit 35B acts in response to the signal Dtq to supply a control signal Sc2 having values of injection timing and injection period corresponding to the signal Dtq to the injection timing control valve 37. This control valve 37, which may be formed of a two-part/two-position type solenoid valve, is held in position 37A to close the fuel supply line 20 when it is not supplied with the signal Sc2, while it is turned into position 37B to open the fuel supply line 20 when supplied with the signal Sc2. The moment and period at and for which the fuel supply line 20 is opened and closed is determined by the moment and period at and for which the signal Sc2 is applied to the valve 37. The injection timing and injection period can be varied by the valve 37 as shown in FIG. 11.

As noted above, according to the invention, the quantity of fuel being injected through the injection nozzle 12 is controlled by means of feedback of a detected value signal obtained by detecting the flow rate of fuel being injected through the injection nozzle 12.

Figure 12:
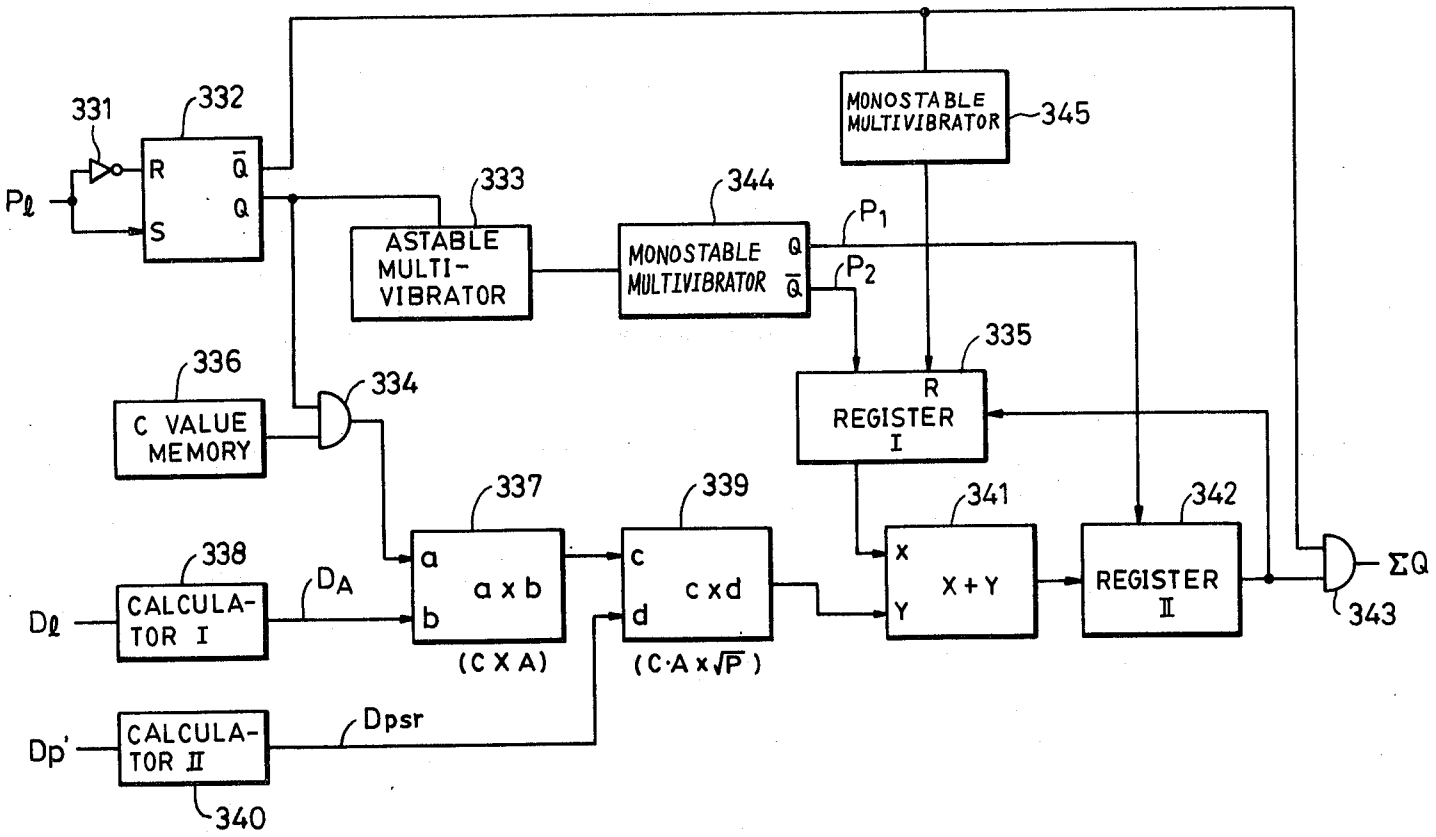
FIG. 12 is a circuit diagram of the actual injection quantity calculating circuit used in CPU in FIG. 7.

FIG. 12 illustrates a circuit provided in CPU 33 in FIG. 7 for calculating an actual injection quantity. This circuit is adapted to execute the program shown in FIG. 5. A pulse signal P1, which is supplied from the waveform shaper 25B in FIG. 7 and corresponds to a nozzle needle lift signal S1, is applied to the S-input terminal and R-input terminal of an RS flip flop 332, directly and by way of an inverter 331, respectively. The Q-output terminal of the flip flop 332 is connected to the feeding terminal of an astable multivibrator 333 and one input terminal of an AND circuit 334. Connected to the other input terminal of the AND circuit 334 is a memory 336 in which the value of constant C is stored. The AND circuit 334 is connected at its output to one input terminal of a multiplier 337 which has its other input terminal connected in the output of a first calculator 338 which is arranged to be supplied with a digital signal D1 from the L/C oscillator 25A in FIG. 7 to produce a signal DA representing the nozzle effective discharge area A corresponding to the signal D1. The first multiplier 337 is connected at its output to one input terminal of a second multiplier 339 which has its other input terminal connected to the output of a second calculator 340. This calculator 340 is arranged to be supplied with a digital signal Dp' from the A/D converter 25C in FIG. 7 to produce a signal Dpsr having a value corresponding to the square root of the value of the signal Dp'. The second multiplier 339 has its output terminal connected to one input terminal of an adder 341. Connected to the other input terminal of the adder 341 is a first register 335 at its output. This first register 335 has its set signal input terminal connected to the output of the $\overline{Q}$-output terminal of the monostable multivibrator 344 which in turn has its input terminal connected to the output of the astable multivibrator 333. The adder 341 is connected at its output to the input terminal of a second register 342. The second register 342 has its set signal input terminal connected to the $\overline{Q}$-output terminal of the monostable multivibrator 344 and its output terminal connected to the input terminal of the first register 335 and one input terminal of an AND circuit 343. Connected to the other input terminal of the AND circuit 343 is the $\overline{Q}$-output terminal of the RS flip flop 332. A monostable multivibrator 345 is connected between the $\overline{Q}$-output terminal of the flip flop 332 and the reset signal input terminal R of the first register 335.

With the above arrangement, when the level of the pulse signal P1 goes high in response to lifting of the nozzle needle 16 in FIG. 7, this high level signal P1 is directly applied to the S-input terminal of the flip flop 332 to set the flip flop 332 so that the flip flop 332 supplies a binary output of 1 through its $\overline{Q}$-output terminal to the feeding terminal of the astable multivibrator 333 and the one input terminal of the AND circuit 334. Then, the astable multivibrator 333 produces pulses with a constant period $\Delta t$ and supplies them to the monostable multivibrator 344. Simultaneously, the AND circuit 334 allows the stored value in the C value memory 336 to be applied to the one input terminal of the first multiplier 337 as input a. Upon application of each pulse from the astable multivibrator 333, the monostable multivibrator 344 produces at its $\overline{Q}$-output terminal a pulse P1 with a constant period, e.g., half as long as $\Delta t$. When the half $\Delta t$ period has lapsed, there occurs inversion in output between the Q, $\overline{Q}$-output terminals of the multivibrator 344. That is, the multivibrator 344 then produces at its $\overline{Q}$-output terminal a pulse P2 with a period half as long as $\Delta t$. On the other hand, the first multiplier 337 is supplied at its other input terminal with the signal DA representing the nozzle effective discharge area A as input b from the first calculator 338. The circuit 337 performs calculation $a \times b$, that is, $C \times A$ to apply the calculated value to the one input terminal of the second multiplier 339 as input c. The second multiplier 339 is supplied at its other input terminal with the signal Dpsr representing the square root of the actual injection pressure from the second calculator 340 as input d, and performs calculation $c \times d$, that is, $\Delta Q = CA \times \sqrt{P}$. The resulting calculated value $\Delta Q$ is applied to the one input terminal of the adder 341 as input Y. The adder 341 is supplied at its other input terminal with a value $\Sigma Q'$ which is the sum of $\Delta Q$'s calculated in the preceding periods $\Delta t$, from the first register 335 as input X, to perform calculation $X+Y$, that is, $\Sigma Q' + \Delta Q$. The calculated value is stored into the second register 342 as the newest sum value $\Sigma Q$ simultaneously when a pulse P1 is applied to the set signal input terminal of the register 342. The value $\Sigma Q$ stored in the second register 342 is shifted into the first register 335 upon a pulse P2 being applied to the set signal input terminal of the register 335. Upon termination of the injection during which the above operations are performed, the nozzle needle lift signal P1 turns low so that a binary output of 1 is applied to the R-input terminal of the flip flop 332 through the inverter 331 and accordingly the flip flop 332 supplies a binary output of 1 through its $\overline{Q}$-output terminal to the one input terminal of the AND circuit 343. The AND circuit 343 has its other input terminal supplied with the value $\Sigma Q$ from the second register 342 to produce this value $\Sigma Q$ at its output. On the other hand, the monostable multivibrator 345 is responsive to the above output of 1 from the $\overline{Q}$-output terminal of the flip flop 332 to apply a pulse to the reset signal input terminal of the first register 335 to reset same to zero.

Obviously many modifications and variations of the present invention are possible in the light of the above teachings. It is therefore to be understood that within the scope of the appended claims the invention may be practiced otherwise than as specifically described.

What is claimed is:

1. A method for controlling the injection of fuel being injected into at least one cylinder of an internal combustion engine through a fuel injection valve having a nozzle holder and a nozzle needle arranged within said nozzle holder, said method comprising the steps of: (1) detecting the lift amount of said nozzle needle of said fuel injection valve by means of a nozzle needle lift sensor arranged within said nozzle holder; (2) detecting fuel pressure present in an injecting fuel passage in said nozzle holder by means of a pressure sensor; (3) arithmetically calculating an actual value of fuel injection quantity from the detected values of nozzle needle lift and fuel pressure in said injecting fuel passage by means of electronic computer means; (4) detecting the values of factors indicative of the operating condition of said engine; (5) arithmetically calculating a required value of fuel injection quantity from the detected values of said factors by means of electronic computer means; (6) arithmetically calculating the difference between said calculated required value of fuel injection quantity and said calculated actual value of fuel injection quantity; and (7) controlling the quantity of fuel to be injected into said cylinder during the next fuel injection with reference to said calculated difference.

2. A method as claimed in claim 1, wherein said nozzle needle lift sensor comprises a coil arranged at a predetermined location within said nozzle holder and a magnetic member inserted in said coil and movable in unison with lifting of said nozzle needle, a change in the inductance of said coil produced by said lifting of said nozzle needle being detected as the lift of said nozzle needle.

3. A method as claimed in claim 1, wherein said pressure sensor comprises a strain gauge arranged for detecting strains produced at a portion of said nozzle holder surrounding said injecting fuel passage.

4. A method as claimed in claim 1, wherein said step (4) includes the step of detecting the load on said engine and the rotational speed of said engine; said step (5) includes the step of calculating a required value of fuel injection quantity corresponding to the detected value of engine rotational speed from predetermined reference injection quantity data to obtain a first control signal; said step (3) includes the step of obtaining a second control signal corresponding to the actual value of fuel injection quantity calculated from the detected values of nozzle needle lift and fuel pressure in said injecting fuel passage; and said step (6) includes the step of calculating the difference between the values of said first control signal and said second control signal.

5. A method as claimed in claim 4, wherein said step (4) includes the step of detecting the temperature of said engine; and said step (5) further includes the step of correcting the value of said first control signal with reference to the detected value of engine temperature.

6. A method as claimed in claim 4 or claim 5, wherein said step (4) includes the step of detecting acceleration and deceleration of said engine; said step (5) further includes the step of correcting the value of said first control signal with reference to the detected values of acceleration and deceleration of said engine.

7. A method as claimed in claim 4, wherein said step (4) includes the step of detecting the top-dead-center position of a piston arranged within said cylinder; said method further comprising the step of (8) arithmetically calculating a required value of injection beginning corresponding to the value of said first control signal and the detected values of engine rotational speed and piston top-dead-center position from predetermined reference injection timing data to obtain a third control signal.

8. A method as claimed in claim 7, comprising the steps of: detecting the lift timing of said nozzle needle; and correcting the value of said third control signal with reference to the detected value of nozzle needle lift timing.

9. A method as claimed in claim 7, wherein said step (4) includes the step of detecting the temperature of said engine; and said step (8) further includes the step of correcting the value of said third control signal with reference to the detected value of engine temperature.

10. A method as claimed in claim 7, 8 or 9, wherein said step (4) includes the step of detecting acceleration and deceleration of said engine; and said step (8) further includes the step of correcting the value of said third control signal with reference to the detected values of acceleration and deceleration of said engine.

11. A method as claimed in claim 4, comprising the step of (8) arithmetically calculating a required value of fuel injection pressure corresponding to the detected values of engine load and engine rotational speed from predetermined reference injection pressure to obtain a fourth control signal.

12. A method as claimed in claim 11, comprising the step of correcting the value of said fourth control signal with reference to the detected value of fuel pressure in said injecting fuel passage.

13. A method as claimed in claim 11, wherein said step (4) includes the step of detecting the temperature of said engine; and said step (9) further includes the step of correcting the value of said fourth control signal with reference to the detected value of engine temperature.

14. A method as claimed in claim 11, 12 or 13, wherein said step (4) includes the step of detecting acceleration and deceleration of said engine; and said step (9) further includes the step of correcting the value of said fourth control signal with reference to the detected values of acceleration and deceleration of said engine.

15. A method as claimed in any one of claims 1–5, 7–9, and 11–13, wherein said step (3) comprises the steps of: obtaining detected values of lift of said nozzle needle and fuel pressure in said injecting fuel passage with respect to each unit time during each injection period; calculating a corresponding value of the effective discharge area of said fuel injection valve from the detected value of nozzle needle lift; calculating a unit fuel injection quantity with respect to said each unit time from the calculated value of effective discharge area and the detected value of said fuel pressure; and summing up a plurality of unit fuel injection quantities thus calculated to obtain a actual value of fuel injection quantity achieved during each injection period.

* * * * *